US007528369B2

(12) United States Patent
Whitehouse et al.

(10) Patent No.: US 7,528,369 B2
(45) Date of Patent: May 5, 2009

(54) CHARGED DROPLET SPRAY PROBE

(75) Inventors: Craig M. Whitehouse, Branford, CT (US); Allan Burt, Branford, CT (US); Glenn Whitehouse, Branford, CT (US); Mike Sansone, Branford, CT (US)

(73) Assignee: Analytica of Branford, Inc, Branford, CT (US)

( * ) Notice: Subject to any disclaimer, the term of this patent is extended or adjusted under 35 U.S.C. 154(b) by 0 days.

(21) Appl. No.: 11/965,448

(22) Filed: Dec. 27, 2007

(65) Prior Publication Data

US 2008/0142704 A1 Jun. 19, 2008

Related U.S. Application Data

(63) Continuation of application No. 11/132,956, filed on May 19, 2005, now Pat. No. 7,315,021.

(60) Provisional application No. 60/573,665, filed on May 21, 2004.

(51) Int. Cl.
*H01J 49/00* (2006.01)

(52) U.S. Cl. ..... 250/288; 250/281; 204/452; 204/603

(58) Field of Classification Search ..... 250/288, 250/281; 204/452, 603
See application file for complete search history.

(56) References Cited

U.S. PATENT DOCUMENTS

| | | | | |
|---|---|---|---|---|
| 6,326,616 | B1 * | 12/2001 | Andrien et al. | 250/288 |
| 6,337,480 | B1 | 1/2002 | Andrien et al. | 250/288 |
| 6,384,411 | B1 | 5/2002 | Hirabayashi et al. | 250/288 |
| 6,573,494 | B1 * | 6/2003 | Andrien et al. | 250/288 |
| 7,315,021 | B2 * | 1/2008 | Whitehouse et al. | 250/288 |
| 2005/0056781 | A1 | 3/2005 | Hirabayashi et al. | 250/288 |

* cited by examiner

*Primary Examiner*—Jack I Berman
*Assistant Examiner*—Johnnie L Smith, II
(74) *Attorney, Agent, or Firm*—Levisohn Berger LLP

(57) ABSTRACT

An improved sample introduction probe is disclosed for the production of ions from liquid sample solutions in an electrospray ion source. Nebulization of a liquid sample emerging from the end of an inner flow tube is pneumatically assisted by gas flowing from the end of an outer gas flow tube essentially coaxial with the inner sample flow tube. The disclosed probe provides for adjustment of the relative axial positions of the ends of the liquid and gas flow tubes without degrading the precise concentricity between the inner and outer tubes. Additionally, the terminal portion of the outer gas flow tube may be fabricated either from a conductive or dielectric material, thereby allowing the pneumatic nebulization and electrospray processes to be optimized separately and independently. Hence, the disclosed invention provides a pneumatically-assisted electrospray probe with improved mechanical and operational stability, reliability, reproducibility, and ease of use compared to prior art probes.

19 Claims, 4 Drawing Sheets

CHARGED DROPLET SPRAY PROBE

CROSS-REFERENCE TO RELATED APPLICATION

This application is a continuation of application Ser. No. 11/132,956 filed on May 19, 2005 now U.S. Pat. No. 7,315,021, which claims the priority of U.S. Provisional Application No. 60/573,665, filed on May 21, 2004, the disclosure of which is incorporated herein by reference in its entirety.

FIELD OF THE INVENTION

This invention relates generally to the field of ion sources, and, more specifically, to the field of electrospray ion sources which produce gas-phase ions from liquid sample solutions at or near atmospheric pressure for subsequent transfer into vacuum for mass-to-charge analysis

BACKGROUND OF THE INVENTION

Electrospray ion sources have become indispensible in recent years for the chemical analysis of liquid samples by mass spectrometeric methods, owing in large part to their ability to gently create gas phase ions from sample solution species at or near atmospheric pressure. Electrospray ionization begins with the production of a fine spray of charged droplets when a liquid flows from the end of a capillary tube in the presence of a high electric field. The electric field causes charged species within the liquid to concentrate at the liquid surface at the end of the capillary, resulting in disruption of the liquid surface and the associated production of charged liquid droplets. Positive or negatively charged droplets are produced depending on the polarity of the applied electric field. Subsequent evaporation of the droplets is accompanied by the emission of gas-phase analyte ions, completing the electrospray ionization process, although the precise mechanisms involved in this last step remain unclear. Frequently, a heated gas flow is provided counter to the electrospray flow to assist the evaporation process. Some of these ions then become entrained in a small flow of ambient gas through an orifice leading into a vacuum system containing a mass spectrometer, thereby facilitating mass spectrometric analysis of the sample analyte species. Electrospray ionization sources are often coupled to mass spectrometers (ES/MS systems) as described in several U.S. Patents (for example: Fite, U.S. Pat. No. 4,209,696; Labowsky et al., U.S. Pat. No. 4,531,056; Yamashita et. al., U.S. Pat. No. 4,542,293; Henion et. al., U.S. Pat. No. 4,861,988; Smith et. al, U.S. Pat. Nos. 4,842,701 and 4,885,076; and Hail et al., U.S. Pat. No. 5,393,975), and in review articles [Fenn et. al., Science 246, 64 (1989); Fenn et. al, Mass spectrometry reviews 6, 37 (1990); Smith et. al., Analytical Chemistry 2, 882 (1990)].

The efficiency of the electrospray ionization process depends on the sample liquid flow rate, and the electrical conductivity and surface tension of the sample liquid. Typically, operation at liquid flow rates exceeding about 10-20 microliters/minute, depending on the solvent composition, leads to poor spray stability and droplets that are too large and polydisperse in size, resulting in reduced ion production efficiency Poor spray stability also results from solutions with high electrical conductivities and/or with a relatively high water content. Because electrospray ion sources are often connected to liquid chromatographs for performing LC/MS, such limitations often conflict with requirements for achieving optimum chromatography, or may even preclude the use of LC/MS for many important classes of applications. Consequently, a number of enhancements to pure electrospray have been devised in an attempt to extend the range of operating conditions that results in good ionization efficiency.

One important enhancement has been the use of a flow of gas at the end of the sample delivery tube to improve the nebulization of the emerging sample liquid. The flow of gas is often provided via the annular space between the inner liquid sample delivery tube and an outer tube coaxial with the inner tube. This approach was originally taught by Mack et al, in J. Chem Phys 52, 10 (1970), and subsequently by Henion in U.S. Pat. No 4,861,988. Essentially, with the proper relative axial positioning of the ends of the coaxial tubes, a gas flow 'sheath' is formed around the liquid as it emerges from the sample delivery tube, resulting in a 'shearing' effect that produces smaller droplets than would otherwise have been produced. By initially forming smaller droplets, a higher percent of desolvated ions results. Such configurations are referred to as pneumatic nebulization-assisted electrospray ion sources.

Optimum ionization and ion transport efficiencies generally depends on the spatial characteristics of the spray plume relative to the vacuum orifice, which, in turn, depends on operational parameters such as the sample liquid and nebulizing gas flow rates and the physicochemical characteristics of the sample liquid. Hence, an ability to properly locate the ends of the sample delivery and nebulizing gas tubes relative to the vacuum orifice is important. The terminal portions of the coaxial tubes are typically housed within a mechanical support structure, commonly referred to as the electrospray 'probe', which protrudes into the enclosed housing of the electrospray ion source. Such probes are often provided with linear and rotational positioning mechanisms to re-optimize the position of the spray plume as the spatial distribution of the plume changes from one analysis to another. Provisions are also often provided for adjusting the relative axial positions of the ends of the sample liquid delivery tube and the coaxial nebulizing gas tube, which may optimize differently depending on the liquid sample characteristics and operating parameters.

While such mechanical adjustments have proven essential for source optimization, nevertheless, the process of achieving maximum performance via such adjustments has frequently been found to be quite tedious. Furthermore, once an optimum configuration is achieved for a particular analysis, it is generally not guaranteed that optimum performance will be reproducible with the same configuration for the same analysis at a later time, especially subsequent to any changes to the source configuration in the interim. One reason for such difficulties lies in the relatively poor control that exists in current electrospray probes over the concentricity between the coaxial sample delivery and nebulizing gas tubes. Typically, the sizes of such tubes are relatively small, being typically on the order of fractions of a millimeter, and the annular gap between the outer diameter of the inner sample delivery tube and the inner diameter of the outer nebulizing gas tube is typically even smaller, often on the order of only tens of micrometers. Hence, maintaining accurate concentricities between these two coaxial tubes has been challenging.

Perhaps even more difficult is maintaining the concentricity constant as the relative axial positions of the ends of the tubes is adjusted. Currently, this adjustment in present sources is generally accompanied by a rotation of the inner sample delivery tube about the axis of the nebulizing gas tube. Hence, any eccentricity between the axes of the sample delivery and nebulizing gas tubes rotates as the relative axial positions of the ends of the tubes is adjusted. The effect of any such eccentricity is to cause the flow of nebulizing gas to be cylindrically assymetric with respect to the axis of the liquid sample emerging from the sample delivery tube. Hence, enhancement of the sample nebulization by the nebulizing gas will be different on different sides of the spray plume, and, perhaps worse, this asymmetry in the spray nebulization rotates about the plume as the relative axial positions of the tube ends is adjusted. The net result is that optimization of the electrospray ion source configuration and operating parameters has been tedious and often ineffective, and has led to poor reproducibility and often poor stability during operation. Accordingly, there is a need for a pneumatical nebulization-assisted electrospray probe with improved ease of use, stability, and reproducibility.

Further, the nature of the materials from which the inner sample delivery tube and the outer nebulizing gas tube are fabricated often influences the quality and stability of the resulting electrospray due to chemical, electrochemical and/or electrostatic interactions with the sample, and/or compatibility with upstream chromatic separation schemes. Hence, different materials have been used, both electrically conductive as well as dielectric, depending on the types of applications and instrument configuration employed. Generally, if different materials are required, an entirely different probe would be necessary, because the design of prior art probes has not provided the capability of easy and rapid exchange of individual parts. Therefore, there has been a need to eliminate the unnecessary expense of utilizing different probes depending on the application.

OBJECTS AND SUMMARY OF THE INVENTION

Accordingly, one object of the invention is to provide an improved electrospray apparatus and method.

It is another object of the invention to provide an improved electrospray apparatus and methods which uses concentric flow of sample liquid and pneumatic nebulization sheath gas.

It is a further object of the invention to provide an improved electrospray apparatus and methods in which the relative axial position of the ends of concentric sample delivery and nebulizing gas tubes is adjustable.

It is an even further object of the invention to provide improved methods and apparatus for optimizing an electrospray apparatus.

It is another object of the present invention to provide an electrospray probe that is easily and inexpensively re-configured with fabricated from materials optimized for particular application requirements.

The foregoing and other objects of the invention are achieved with a nebulization-assisted electrospray probe with means to adjust the axial position of the central sample delivery tube relative to that of the outer nebulizing gas tube during operation, while simultaneously ensuring that accurate and precise coaxial alignment between the two tubes is always maintained independent of any axial adjustment. By capturing the tubes at multiple points within the disclosed probe and piloting the main sections to one another with high tolerance, improved mechanical stability and concentricity results. A linear translation mechanism provides for adjustment of the relative axial position of the tubes' ends without incorporating any rotation of either tube, thereby eliminating any mechanical distortions or misalignments associated with such rotations. The improved stability additionally allows more practical operation at lower flow rates than was previously possible with a pneumatic nebulization assisted probe, thereby extending the range of operation.

Further, both the inner and outer tubes may be fabricated from either conductive or dielectric materials, and provisions are made for easy exchange of such components, thereby providing improved flexibility to accommodate a wider range of application requirements. For example, the analysis of electrochemically-sensitive analytes may preclude contact of the sample solution with any metallic surfaces, in which case a dielectric material may be used for both the inner and outer tubes. Alternatively, for other analyses, the inner sample delivery tube may be conductive, while the outer nebulizing gas tube may be dielectric. This configuration provides a well-defined electric field contour in the vicinity of the emerging sample liquid, independent of any axial position adjustment between the inner and outer tubes. On the other hand, analysis with high sensitivity of low-concentration analytes in the presence of a relatively high charge density in the electrospray plume benefits from a conductive outer tube by avoiding any static charge build-up on the surface of a dielectric outer tube, which distorts the electric fields in the vicinity of the spray plume and degrades ionization efficiency.

Hence, the present invention provides a pneumatic nebulization-assisted electrospray ionization probe with improved ease and flexibility of use, stability, reliability, and reproducibility.

BRIEF DESCRIPTION OF THE DRAWINGS

The foregoing objects and descriptions, and additional, objects, features, and advantages of the invention, will be apparent to those skilled in the art from the following detailed description of the preferred embodiments thereof, especially when considered in conjunction with the accompanying figures, in which.

DETAILED DESCRIPTION OF THE PREFERRED EMBODIMENTS

Figure 1:
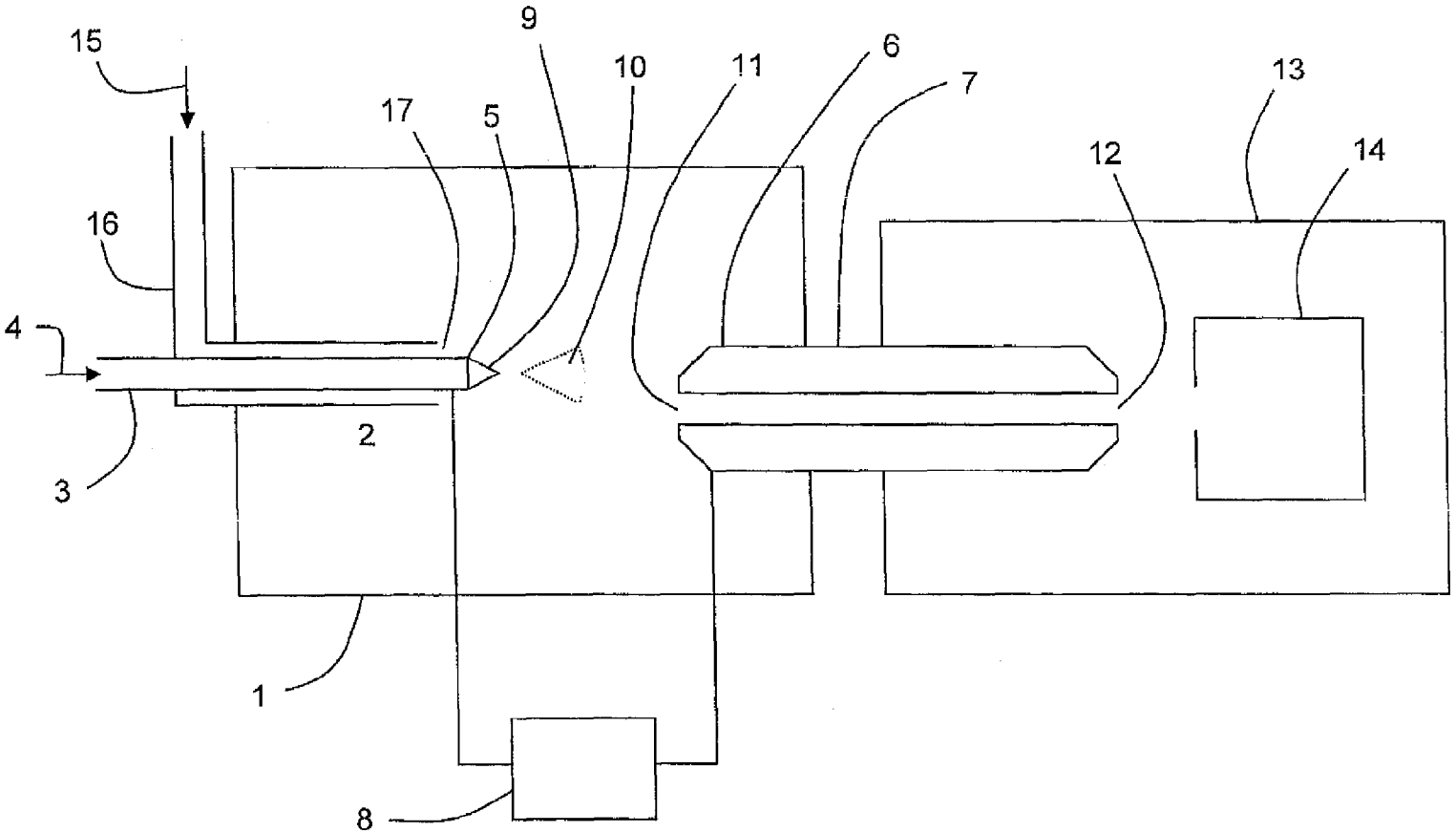
FIG. 1 represents a schematic of a pneumatic nebulization-assisted electrospray ionization source and interface to a analytical detection system that is held under vacuum.

Turning now to a detailed description of preferred embodiments, FIG. 1 shows schematically a typical well-known configuration for a pneumatic nebulization-assisted electrospray ion source 1 in which the present invention would be incorporated. The source 1 includes a pneumatic nebulization assisted electrospray probe 2 essentially comprising liquid sample delivery tube 3 which delivers liquid sample 4 to sample delivery tube end 5. A voltage differential between tube end 5 and the entrance end 6 of capillary vacuum interface 7 is provided by high voltage DC power supply 8. The resulting electrostatic field in the vicinity of sample delivery tube end 5 results in the formation of an electrospray plume 10 from emerging sample liquid 9. Sample ions released from evaporating droplets within plume 10 are entrained in background gas flowing into capillary vacuum orifice 11, from which the ions are carried along with the gas to the capillary exit end 12 and into vacuum system 13. Once in vacuum, the ions may be directed to a mass spectrometer 14 for mass-to-charge analysis. In order to enhance nebulization and ionization efficiencies, probe 2 also comprises nebulization gas 15 delivered though nebulization gas tube 16 with exit opening 17 which is proximal to and, ideally, coaxial with liquid sample delivery tube 3 exit end 5.

Achieving maximum enhancement by the nebulization gas requires that the relative axial positions of the nebulizing gas tube exit opening 17 and the sample delivery tube end 5 be optimized, so provision is often provided for such adjustment, usually by providing adjustment of the position of the sample delivery tube. With the disclosed invention, such an adjustment is provided while also maintaining accurate coaxial alignment between the sample delivery and nebulizing gas tubes One embodiment of the present invention is illustrated in the cross-sectional drawing depicted in FIG. 2. Liquid sample 4 is introduced into pneumatic nebulization-assisted electrospray probe 2 at liquid sample introduction port 20 in union fitting 21 via a capillary (not shown) that is plumbed into union fitting 21 using standard compression ferrule-style coupling (not shown), as is well known in the art. The entrance end 22 of sample delivery tube 3 is similarly plumbed into the downstream end of union 21 using ferrule 23 and compression nut 24, causing the entrance end 22 of sample delivery tube 3 to be rigidly captured in union 21. Thus, sample liquid 4 enters the entrance end 22 of sample delivery tube 3, which carries the sample liquid the length of probe 2 to the exit end 5 of sample delivery tube 3.

Union fitting 21 is located within a bore hole 25 of probe body 26. A relatively close fit between the union 21 and the bore 25 restricts sideways motion of the union 21 but allows the union 21 to move freely in the axial direction along the bore 25. The upstream face of union 21 is forced against the inside face of adjustment knob 27 by compression spring 28 pushing back on the downstream face of union 21. Adjustment knob 27 is threaded onto probe body 26, so that turning adjustment knob 27 one way causes axial displacement of union 21, and hence, of sample delivery tube 3, in one direction, and turning adjustment knob 27 the other way causes axial displacement of union 21 and sample delivery tube 3 in the opposite direction. Union fitting 21 also includes a slot 29 machined along the length of union 21. A key 30 protrudes radially in from the wall of probe body 26 and fits closely within slot 29. This key 30 and slot 29 arrangement allows union 21 to move freely in the axial direction but prevents any significant rotational motion of union 21 as union 21 moves in and out axially. Hence, the exit end 5 of sample delivery tube 3 is provided with axial position adjustment without any significant rotational motion of sample delivery tube 3. Hence, axial position adjustment is provided without any consequential misalignment of the exit end 5 of sample delivery tube 3 that such rotational motion produces in prior art sources.

Probe body 26 is mechanically mated to probe base 31 via screw threads 32, and probe body 26 and probe base 31 are coaxially aligned at locating shoulder 33. Similarly, nose piece 34 is mechanically mated to probe base 31 via screw threads 35, and nose piece 34 and probe base 31 are coaxially aligned at locating shoulder 36. Light tolerances on mating surfaces at locating shoulders 33 and 36 ensure that the errors in concentricity between probe base 31, probe body 26, and nose piece 34 are small.

Figure 2:
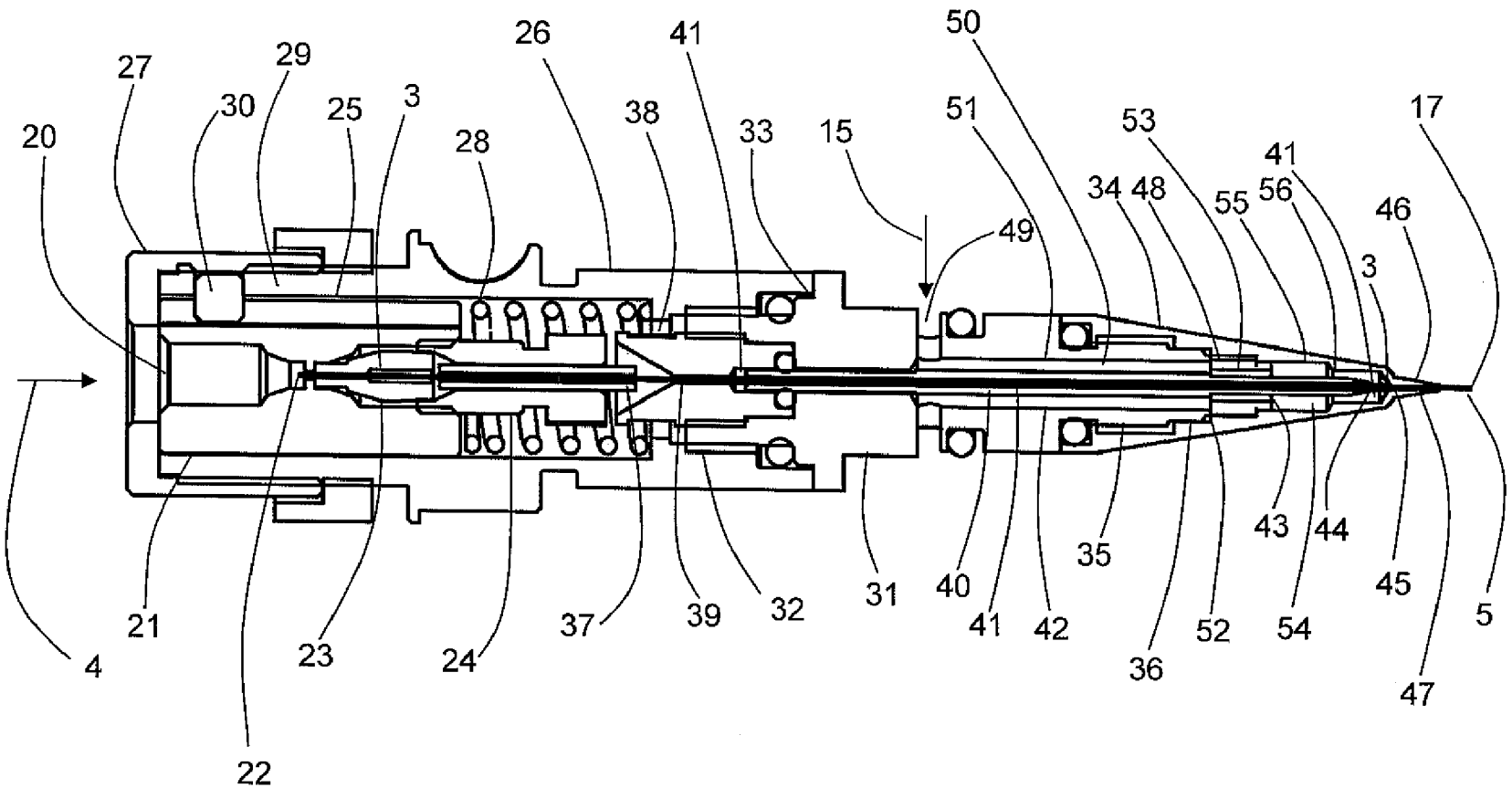
FIG. 2 is a schematic representing a cross-sectional view of a preferred embodiment of the disclosed charged droplet spray probe invention.
Figure 3:
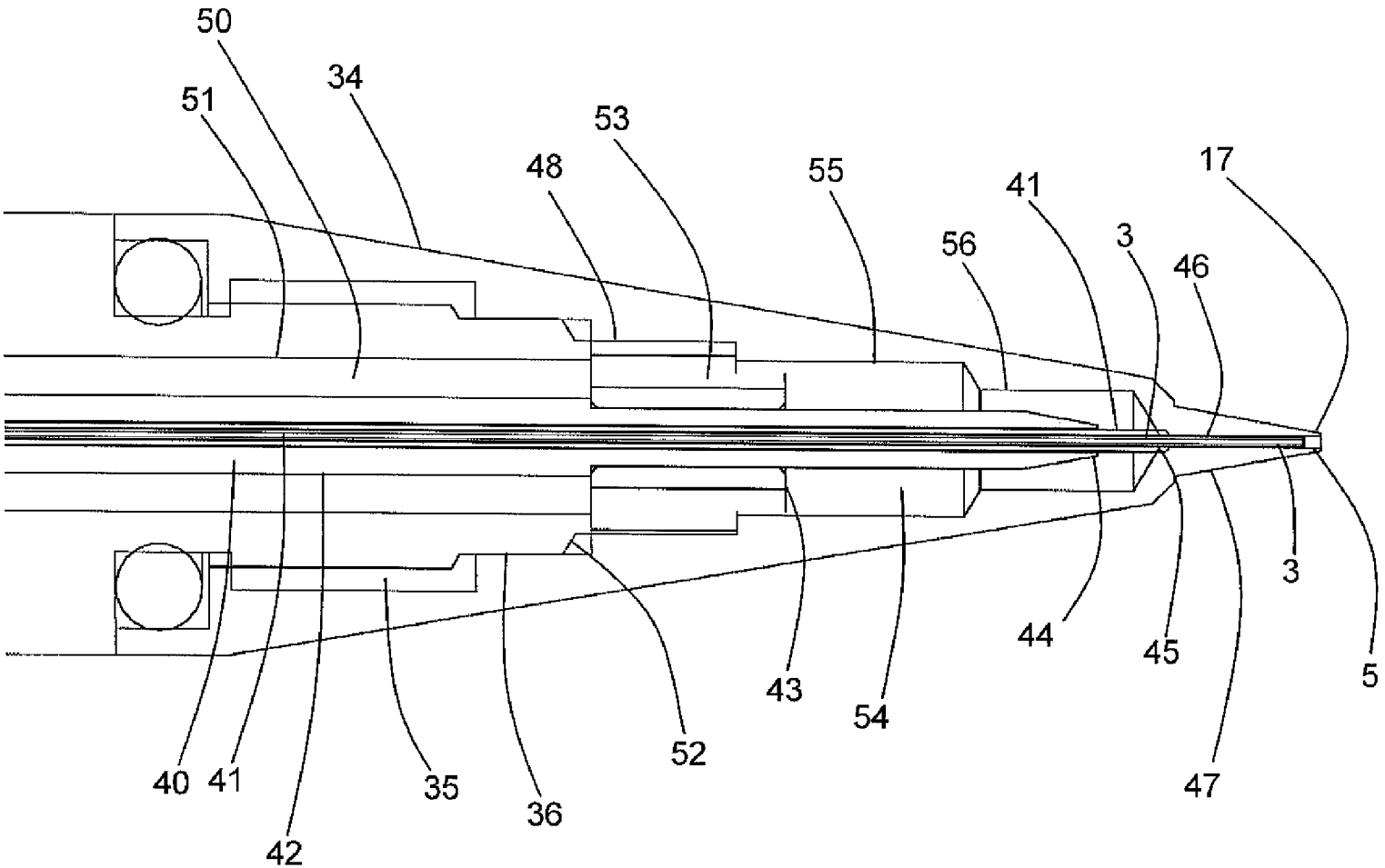
FIG. 3 represents a magnified view of the end portion of the preferred embodiment of the disclosed charged droplet spray probe invention shown in FIG. 2. This figure indicates that the sample introduction tube can be positioned within the dielectric support while still achieving electric field penetration needed to maintain electrospray. In addition, it is noted that the sample introduction tube can be constructed with a blunt tip.
Figure 4:
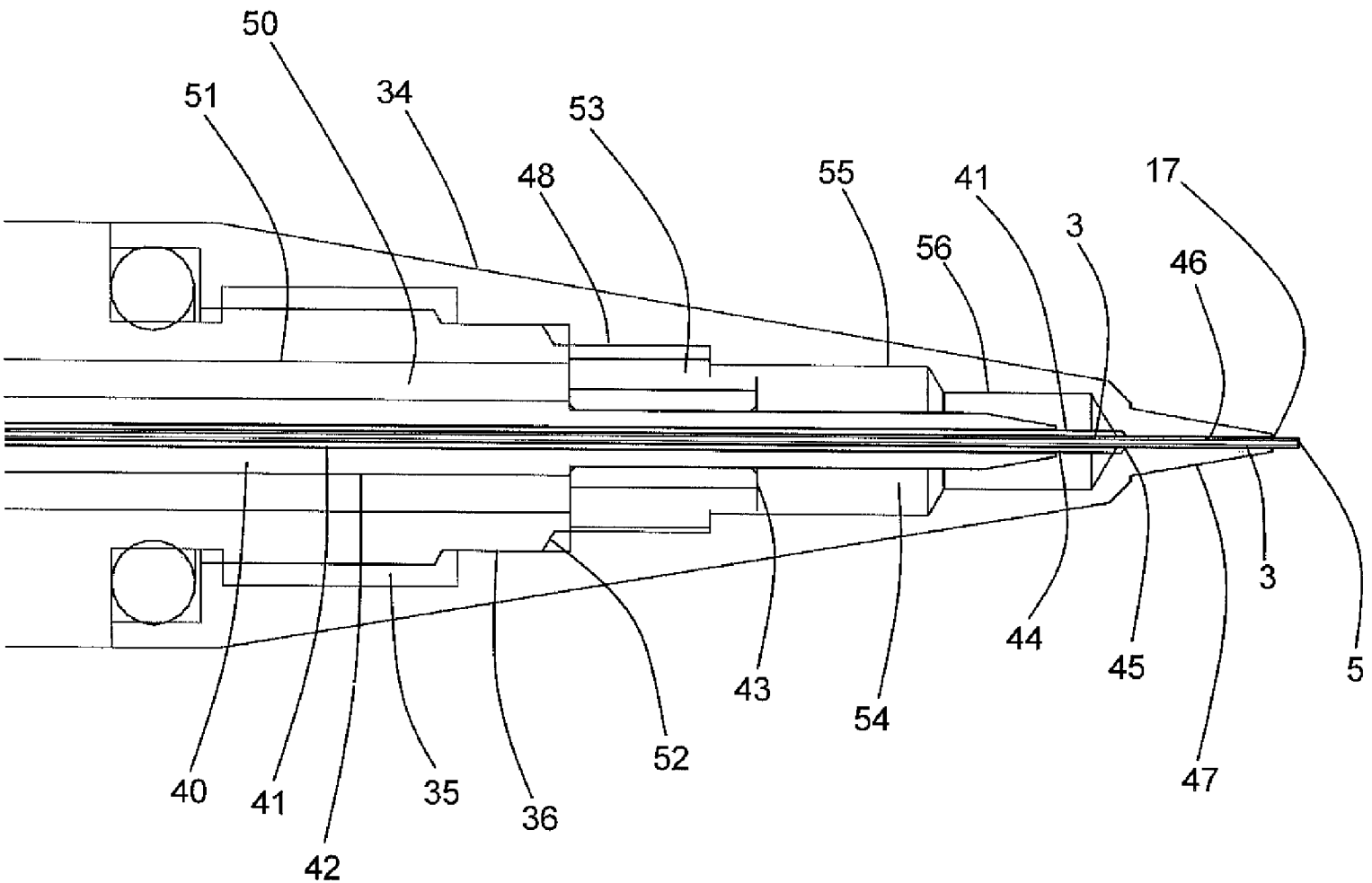
FIG. 4 represents a magnified view of the end portion of another preferred embodiment of the disclosed charged droplet spray probe invention shown in FIG. 2. This schematic indicates that the sample introduction tube can protrude out of the dielectric support in order to tune nebulization if needed. Furthermore, the sample introduction tube can be constructed with a sharp tip which is preferred so that the electric field strength at the tip can be maximized

The sample delivery tube 3 extends from ferrule 23 in union 21 through compression nut 24, via sleeve tube 37, and passes through guide fitting 38, which is screwed into probe base 31. Guide fitting 38 captures and radially locates the entrance end 39 of a guide tube assembly 40, which may be fabricated as a single part, or which may be fabricated more practically from multiple parts which, when assembled, provides essentially the same functions as if fabricated from a single part. For example, guide tube assembly 40 is shown in FIGS. 2 and 3 as an assembly of a guide tube 41 and a sleeve tube 42, in which the outer diameter of the guide tube 41 fits tightly within the bore of sleeve tube 42. Guide tube assembly 40 also comprises a locating flange 43, the function of which will be explained below. Sample delivery tube 3 extends through the bore of guide tube assembly 40, which, in the embodiment shown in FIGS. 2 and 3, is the same as the bore of guide tube 41. The bore of guide tube assembly 40 is just slightly larger than the outer diameter of the sample delivery tube 3. As shown in FIG. 2, and more clearly in the magnified views of FIGS. 3 and 4, the downstream end 44 of guide tube assembly 40 is located just upstream of the entrance end 45 of bore 46 of nose piece 34. Bore 46 of nose piece 34 is located within the downstream tip portion 47 of nose piece 34. Sample delivery tube 3 extends through the downstream end 44 of guide tube assembly 40 and passes through bore 46 of nose piece 34, terminating proximal to the exit opening 17 of bore 46 of nose piece 34. The proximity of exit end 5 of sample delivery tube 3 to exit opening 17 is adjustable as described previously using adjustment knob 27 to translate sample delivery tube 3 along its axis Hence, the magnified view of FIG. 3 shows that exit end 5 of sample delivery tube 3 may be positioned upstream of exit opening 17 of bore 46, while exit end 5 of sample delivery tube 3 may alternatively be positioned downstream of exit opening 17 of bore 46 as shown in FIG. 4 The annular opening formed between the outer surface of the sample delivery tube 3 and the bore 46 of nose piece 34 provides a conduit for nebulizing gas 15, as described in mole detail below.

Guide tube assembly 40 also comprises a locating flange 43, which locates the axis of guide tube assembly 40 to be concentric with bore 48 of nose piece 34 with high precision. A similarly precise concentricity is held between bores 48 and 46 of nose piece 34. Also, the axis of guide tube assembly 40 is held concentric with the axis of probe base 31 with high precision, while the concentricity between the axis of probe base 31 and the axis of nose piece 34 is held with similarly high precision. The net result is that the error in concentricity between the axis of the sample delivery tube 3 and the bore 46 of nose piece 34 is substantially reduced compared to prior art sources.

Gas 15 for nebulization is provided via gas inlet 49. Gas 15 flows from gas inlet 49 through annular conduit 50 that is formed between the outer surface of guide tube assembly 40 and the bore 51 in probe base 31. Gas 15 continues to flow past the downstream end 52 of probe base 31 through slots 53 provided in locating flange 43 of guide tube assembly 40. Once past locating flange 43, gas 15 continues to flow via the annular conduit 54 formed by the bores 55 and 56 of nose piece 34 and the outer surfaces of guide tube assembly 40. Flowing past the downstream end 44 of guide tube assembly 40, gas 15 then enters the entrance end 45 of bore 46 of nose piece 34, and flows along the annular conduit formed by bore 46 of nose piece 34 and the outer surface of sample delivery tube 3, until the gas 15 finally exits bore 46 of nose piece 34 via exit opening 17. The annular flow of gas 15 flowing out exit opening 17 of nose piece 34 surrounds the sample liquid emerging from exit end 5 of sample delivery tube 3 and assists in the nebulization of the emerging sample liquid. Hence, the bore 51 in probe base 34 and the bores 48, 55, 56, and 46 in nose piece 34 function as a gas delivery tube.

Because the error in concentricity between the axis of the sample delivery tube 3 and the bore 46 of nose piece 34 is very small, as described above, the annular flow of nebulizing gas 15 is very uniform about the axis of flow, resulting in an electrospray plume that is very symmetrical about the plume axis, and which is reproducible from one probe to another Because good concentricity is maintained as the sample delivery tube 3 exit end 5 is adjusted axially, the electrospray conditions may be more readily optimized and reproduced than with prior art electrospray ion sources.

The formation of liquid sample emerging from the exit end 5 of sample delivery tube 3 into an electrospray plume depends in large part on the electric field distribution in the space proximal to exit end 5 of sample delivery tube 3, which, in turn, depends on the shape of the electrically conductive surfaces bordering this space. The reason for this is that the electric fields are generated by the potential difference between these electrically conductive surfaces and the potential of counter electrodes spaced a short distance away from the exit end 5 of sample delivery tube 3, so the electric fields terminate on these surfaces, and the electric field contours proximal to exit end 5 conform to the contours of these electrically conductive surfaces. The surfaces proximal to exit end 5 of sample delivery tube 3 include the outer surfaces of sample delivery tube 3 and the outer surfaces of the nose piece 34. Either or both of the sample delivery tube 3 and the nose piece 34 may each be made either of conductive or non-conductive, that is, dielectric, material.

In one embodiment, the sample delivery tube 3 is fabricated of conductive material, such as stainless steel or platinum, while the nose piece 34 is fabricated from dielectric material, such as fused silica, polyaryletherketone (PEEK), polytetrafluoroethylene (PTFE, or Teflon), and the like. In this embodiment, the electric field terminates on the outer surfaces of the sample delivery tube 3, including the outer surfaces along the length of the portion of the tube 34 near the exit end 5, as well as the edge face of the exit end 5. Because dielectric materials are substantially transparent to electric fields, the shape of nose piece 34 will have an insignificant effect on the shape of the electric fields proximal to exit end 5 Perhaps more importantly, however, because outer surfaces of the nose piece 34 have negligible effect on the electric field gradient proximal to exit end 5 of sample delivery tube 3, the relative axial positions of the exit end 5 of sample delivery tube 3 and the exit opening 17 of nose piece 34 may be adjusted to optimize the effectiveness of nebulizing gas 15 flowing from exit opening 17, without significantly effecting the electric field gradients in the space proximal to exit end 5 that generate the electrospray plume Consequently, the electrospray process via the electric field at exit end 5 and the pneumatic nebulization process may be optimized separately and independently The edge face of exit end 5 may be formed as a blunt face, as shown in FIGS. 2 and 3, or may be shaped as a cone by 'sharpening' the end, which enhances the electric field gradient in the space proximal to the face of exit end 5, as shown in FIG. 4.

On the other hand, due to the non-conductive nature of dielectric materials, it was found that charge may build up during operation on the surfaces of a nose piece 34 if it is fabricated from such materials. The effect of such surface charge on nose piece 34 is to distort the electric fields proximal to the surface charge, that is, proximal to exit end 5 of sample delivery tube 3, thereby degrading the stability of operation in some analytical situations. It was found that stability of operation in such cases was substantially improved by incorporating a small-angle taper to the portion of the nose piece 34 at least proximal to the exit end 5. Further, it was also found that even better stability could be achieved in such cases by minimizing the dielectric surface area of the portion of the nose piece 34 proximal to exit end 5 by fabricating the nose piece 5 in at least two sections, whereby only the downstream portion proximal to exit end 5 is fabricated from dielectric material while the upstream portion is fabricated from conductive material In cases where surface charging is even more severe, a second embodiment may be more advantageous, in which nose piece 34 is fabricated completely from conductive material, which would then preclude any charge build-up on its surface, while the sample delivery tube is fabricated from conductive material. In this case, the shapes of the outer surfaces of nose piece 34, especially those of the downstream tip portion 47, may have a significant effect on the electric field distribution proximal to exit end 5 of sample delivery tube 3. Therefore, it is often advantageous to enhance the electric field gradient proximal to the exit end 5 of sample delivery tube 3 by fabricating the tip portion 47 of nose piece 34 as a small-angle conical shape, for example, with a cone half-angle of about ten degrees or less, although even larger cone angles may also be advantageous, and terminating at exit opening 17 as a relatively sharp circular edge, as shown in FIGS. 2 and 3

Some applications require the analysis of species which may be very electrochemically active, and which react with the inside walls of the sample delivery tube 3 during operation in case it is fabricated from a conductive material such as stainless steel or platinum. In such situations, it may be advantageous to fabricate the sample delivery tube 3 from a dielectric material to avoid such sample degradation during transport of the sample liquid along the sample delivery tube 3. However, being fabricated from a dielectric material, the surfaces of the exit end portion of sample delivery tube 3 would no longer effect the electric field gradient in the space proximal to exit end 5 of sample delivery tube 3. In this case, the nose piece 34 fabricated from conductive material acts to define the electric field contour in the space proximal to the exit end 5 of sample delivery tube 3. By fabricating the tip portion 47 of nose piece 34 as a small-angle conical shape with a sharpened circular edge at exit opening 17, as described above, the tip portion 47 of nose piece 34 at exit opening 17 will then concentrate the electric field gradient in the space proximal to the exit end 5 of sample delivery tube 3, thereby facilitating an electrospray plume, in much the same manner as with a conductive sample delivery tube 3.

Alternatively, both the sample delivery tube 3 as well as the nose piece 34 may both be fabricated from dielectric material, as the electric field contour will then be defined by the liquid sample solution itself, provided that the liquid sample solution is of sufficient electrical conductivity.

Although the present invention has been described in accordance with the embodiments shown, one of ordinary skill in the art will recognize that there could be variations to the embodiments, and those variations would be within the spirit and scope of the present invention.

What is claimed is:

1. A charged droplet sprayer apparatus for producing ions from a liquid sample, comprising:

a) a sample delivery tube comprising an enhance end and an exit end, for transporting a liquid sample downstream from said entrance end to said exit end;

b) a guide tube though which said sample delivery tube extends, said guide tube allowing said sample delivery tube to move freely along the axis of said guide tube while essentially preventing displacement of said sample delivery tube in any direction orthogonal to said guide tube axis;

c) a conduit for gas flow, said conduit comprising the annular space between at least a portion of said sample delivery tube proximal to said exit end, and a gas flow tube surrounding and essentially coaxial with said portion, the exit opening of said gas flow tube being proximal to said exit end of said sample delivery tube;

d) means for flowing gas though said gas flow conduit;

e) means for forming an electric field at said exit end;

f) means for adjusting the relative axial positions of said exit end of said sample delivery tube and said exit opening of said gas flow tube; and, g) a vacuum system, comprising a vacuum interface orifice for transporting said ions into said vacuum system.

2. The apparatus of claim 1, whereby said sample introduction tube comprises an electrically conductive material, and said gas flow tube comprises a dielectric material.

3. The apparatus of claim 1, whereby said sample introduction tube comprises an electrically conductive material, and said gas flow tube comprises an electrically conductive material.

4. The apparatus of claim 1, whereby said sample introduction tube comprises a dielectric material, and said gas flow tube comprises an electrically conductive material.

5. The apparatus of claim 1, whereby said sample introduction tube comprises a dielectric material, and said gas flow tube comprises a dielectric material.

6. The apparatus of claim 1, whereby said gas flow tube comprises a dielectric material proximal to and including said exit opening, and comprises a conductive material elsewhere.

7. The apparatus of any of claims 1, 2, 3, 4, 5, or 6, wherein said means for adjusting the relative axial positions of said exit end of said sample delivery tube and said exit end of said gas flow tube further comprises means for maintaining the relative angular orientation between said sample delivery tube and said gas flow tube essentially constant dining said adjustment.

8. The apparatus of any of claims 1, 2, 3, 4, 5, or 6, wherein said gas flow tube comprises a tapered outer surface profile with a low-angle taper; such that the cross-sectional outer dimension of said gas flow tube decreases in the downstream direction.

9. The apparatus of any of claims 1, 2, 3, 4, 5, or 6, wherein said exit end of said sample delivery tube has a blunt face.

10. The apparatus of any of claims 1, 2, 3, 4, 5, or 6, wherein said exit end of said sample delivery tube has a sharpened-edge face.

11. The apparatus of any of claims 1, 2, 3, 4, 5, or 6, wherein said exit opening of said gas flow tube has a blunt face.

12. The apparatus of any of claims 1, 2, 3, 4, 5, or 6, wherein said exit opening of said gas flow tube has a sharpened-edge face.

13. The apparatus of any of claims 1, 2, 3, 4, 5, or 6, wherein said exit end of said sample delivery tube is located proximal to and upstream of said exit opening of said gas flow tube during operation.

14. The apparatus of any of claims 1, 2, 3, 4, 5, or 6, wherein said exit end of said sample delivery tube is located proximal to and downstream of said exit opening of said gas flow tube during operation.

15. The apparatus of any of claims 1, 2, 3, 4, 5, or 6, wherein said exit end of said sample delivery tube is located at essentially the same axial position as said exit opening of said gas flow tube during operation.

16. The apparatus of any of claims 1, 2, 3, 4, 5, or 6, wherein said means for forming an electric field comprises maintaining said sample delivery tube and said gas flow tube at ground potential.

17. The apparatus of any of claims 1, 2, 3, 4, 5, or 6, wherein said means for forming an electric field comprises high voltage applied to said sample delivery tube and said gas flow tube.

18. The apparatus of any of claims 1, 2, 3, 4, 5, or 6, wherein said means for forming an electric field comprises high voltage applied to said vacuum interface orifice.

19. The apparatus of any of claims 1, 2, 3, 4, 5, or 6, further comprising a mass spectrometer in said vacuum system for mass-to-charge analyzing said ions transported into said vacuum system.

* * * * *